United States Patent [19]

Bencriscutto

[11] Patent Number: 4,836,294

[45] Date of Patent: Jun. 6, 1989

[54] MACHINE FOR DIGGING A PUTTING CUP HOLE

[76] Inventor: Michael Bencriscutto, 6121 Golf Ridge Dr., Racine, Wis. 53402

[21] Appl. No.: 216,003

[22] Filed: Jul. 7, 1988

[51] Int. Cl.[4] ..... E02F 5/20

[52] U.S. Cl. ..... 172/22; 175/313; 175/203; 175/161; 172/111; 172/25

[58] Field of Search ..... 172/21, 22, 19, 20, 172/25, 446, 447, 448, 673, 111, 667; 175/220, 313, 203, 161, 162

[56] References Cited

U.S. PATENT DOCUMENTS

| | | | |
|---|---|---|---|
| 2,969,121 | 1/1961 | Wallace | 175/220 X |
| 3,017,935 | 1/1962 | Galbraith et al. | 173/27 X |
| 3,057,415 | 10/1962 | Cox | 175/84 |
| 3,152,653 | 10/1964 | Sievers | 175/313 X |
| 3,224,512 | 12/1965 | Alexander | 172/22 X |
| 3,252,523 | 5/1966 | Kachnik et al. | 172/448 X |
| 3,324,958 | 6/1967 | Clark | 175/84 |
| 3,700,045 | 10/1972 | Coontz | 175/162 X |
| 3,817,337 | 6/1974 | Panak et al. | 172/22 X |
| 4,124,080 | 11/1978 | McCause | 172/667 X |
| 4,763,735 | 8/1988 | Gay | 172/22 X |

*Primary Examiner*—Richard J. Johnson

*Assistant Examiner*—Jeffrey L. Thompson

*Attorney, Agent, or Firm*—James E. Nilles; Donald C. McGaughey

[57] ABSTRACT

A putting cup hole digging machine is disclosed which comprises a main frame which has a fore and aft extent; a first mounting means for securing the main frame on a vehicle to permit the main frame to be vertically raised and lowered relative to the vehicle; and a first raise-lower means secured to the main frame for raising and lowering it relative to the vehicle. The machine also includes a subframe secured on the main frame by a second mounting means permitting pivotal movement of the subframe about a second horizontal axis and fore and aft movement of the subframe relative to the main frame; a cutter for cutting the cylindrical turf plug which is mounted on the subframe; and a third mounting means for securing the cutter on the subframe for vertical movement to raised and lowered positions relative to the subframe and for rotary movement relative to the subframe about a third axis. A second raise and lower means is provided to move the cutter between its raised and lowered positions. The machine also includes a drive means secured to the cutter for rotating it about the third axis; and plug ejection means mounted on the subframe and selectively operable to eject the turf plug.

19 Claims, 7 Drawing Sheets

MACHINE FOR DIGGING A PUTTING CUP HOLE

BACKGROUND OF THE INVENTION

1. Field of the Invention

This invention relates to a vehicle mounted machine for cutting and removing a plug of turf to create a new putting cup hole in a golf putting green and, if desired, for moving the newly cut turf plug to an old cup hole and inserting it therein to close it.

2. Description of the Prior Art

In order to prevent undue wear and deterioration of golf course putting greens around the putting cup, it is generally accepted practice to change the location of the cup on each playing green and on the practice greens frequently, preferably once each day. At present, a manual plug cutter, comprising a handle with a hollow cylindrical cutter at the end thereof, is used to cut putting cup holes. The cutter is pressed downward and twisted into the turf to a depth of eight inches to cut a turf plug having an outside diameter equal to the diameter of the putting cup. The cutter is lifted from the earth with the plug therein which is used to fill the old cup hole. The dept of penetration of the cutter is always the same, as the new plug should be of a length sufficient to exactly fill the old hole with the top thereof exactly flush with the surrounding surface of the green. In practice, it is very difficult to always obtain a turf plug of consistent length because some of the soil breaks free from the end of the turf plug and falls away when the plug is removed from the ground. Thus, the turf plug is usually too short and it must be trial fitted into the old hole. If it is too short it must be removed to permit a mixture of sand and soil to be added to the bottom of the old cup hole. When the fitting is completed, the turf plug is inserted and tamped down. This fitting of the turf plug is an exacting procedure that takes time and the turf plug is frequently improperly fitted into the old hole. Examination of any putting green will show a plurality of slight depressions each caused by a turf plug that was not long enough and which subsided after repeated watering of the green and also scalped areas where the turf plug was a little too long causing the top of the plug to be slightly above the surrounding surface and thus scalped by the mower during grass cutting.

One reason that soil breaks free from the manually cut turf plug is that the root system of the turf that holds the soil within the plug is broken as the plug is being cut. The roots will grow down as far as fourteen inches and this network of roots, if unbroken, will hold the soil in the plug together. Also it is very important to retain this root system in a turf plug intact as the root system provides the strength for new grass growth when the plug is transplanted. When the cutter is inserted into the ground, the soil will adhere to the inside of the cutter and this adhesion is why the turf plug will remain in the cutter when it is pulled from the ground after the plug has been cut. However, this adhesion also causes root breakage during manual cutting of the turf plug. In cutting the cup hole manually, the cylindrical cutter is usually twisted about 180° and then stopped as the operator must alternate his grip on the handle or the cutter is twisted back and forth with the cutter stopping each time the direction of cutter rotation changes. As discussed above, when the cutter stops, the soil and turf of the plug adheres to the inside of the cutter and when rotation of the cutter is started again, the plug will tend to rotate with the cutter resulting in a shearing action at the interface where the soil within the cutter meets the stationary soil in the ground below the cutter. This shearing breaks the roots. Root breakage can occur quite close to the surface. This shearing action is accentuated by wobbling the cutter handle which causes the plug to be tilted and, in addition, wobbling can cause the hole to be larger than the cup insert. Ideally, the plug when cut should comprise one continuous, unbroken turf cylinder with the network of roots intact to hold all the soil so the plug is always the same length. In actual practice, it is not at all unusual for the shearing action to take place several times as the cutter is started and stopped, sometimes resulting in the soil fracturing to the degree that much of the soil may fall out as the cutter is removed thus making a mess on the green and making depth control even more difficult. More importantly, the destruction or shortening of the root system in the turf weakens the grass and can result in dead or sickly spots on the green.

The changing of putting cup hole locations if done right can take as much as three hours of the greenkeeper's time each day and therefore is expensive. In spite of the time involved to change putting cup locations and the unreliable results of hand plugging of the old hole, there has not been a commercially successful mechanical putting cup hole cutting machine developed for mounting on a power driven vehicle that meets desired requirements.

More specifically, some of the requirements that a mechanical putting cup hole cutting machine should meet are as follows. The machine should permit the vehicle to be located in the general area where the cup hole is to be dug, and while the machine is stationary, permit the cutter to be accurately repositioned independently of the vehicle in both fore, aft and lateral directions to a precise hole location. It is also desirable that the vertical axis of the cutter be adjustable to assure that the cup hole axis will be vertical so the "pin" or flag staff will stand straight up in the cup. The ability to precisely locate the putting cup is necessary for various reasons. For example, golf tournament committees designate different exact locations for the pin each day of the tournament. Also when the new turf plug has been cut, it is necessary that the vehicle be repositionable to the general area of the old hole and the cutter then accurately repositioned independently of the vehicle so that the cutter can be accurately aligned to insert the turf plug into the old cup hole.

In addition, the machine should have provision to permit the turf plug to be retained or not retained in the cutter. For example, when cutting a new cup hole, the plug should be allowed to remain within the cutter as the cutter is withdrawn from the ground. This permits the cutter with the turf plug therein to be moved to and inserted in the old cup hole. By being able to accurately reposition the cutter, the turf plug can be retained in the cutter and manual handling of the plug avoided. This will minimize root system breakage and maintain precise turf plug length to minimize leveling and subsidence problems. After inserting the plug in the old cup hole, the cutter must be withdrawn and while doing so it is necessary that a means be provided to hold the turf plug in the ground as the cutter is withdrawn.

The machine should be compact and light in weight so that it can be mounted on a vehicle such as a tractor mounted mower for cutting the greens and retained thereon even when the tractor is in use to cut the grass on putting greens. This will permit the cup location to be changed at the same time the green is cut to save time. The machine should also permit easy attachment on and detachment from the tractor and be powered preferably by hydraulic actuators so as to be able to use the existing hydraulic system of the tractor.

The cutter per se will be subject to wear and dulling of the cutting edge and the service of a cutter at or near the ground is difficult and time consuming. Thus, it is preferable that the machine has provision to permit the cutter to be easily and quickly orientated to and locked in a special service position convenient for cutter removal or sharpening.

U.S. Pat. No. 3,817,337, issued June 18, 1974 to Philip F. Panak and Elwin J. Bronson, discloses a machine for making holes in putting greens. This machine makes no provision for adjusting the fore and aft, lateral and vertical alignment of the cutter relative to the vehicle. Further, this machine first forces the cutter down into the turf without cutter rotation until downward action is resisted, at which time rotation of the cutter is started. This is an undesirable procedure because on many occasions the plug of turf in the cutter will rotate with the cutter and break off the root system.

There are also prior patents relating to soil sampling machines which either use augers or force a core cutting tube cutter into the ground. U.S. Pat. Nos. 3,057,415, issued Oct. 9, 1962 to P. D. Cox, and 3,324,958, issued June 13, 1967 to R. A. Clark, are typical of such machines. These soil sampling machines have no provision for ultra-precise relocation of the cutter position after the vehicle is in a stationary position. U.S. Pat. No. 3,224,512, issued Dec. 21, 1965 to J. P. Alexander, discloses a typical soil sampler having a cutter that can be tilted about a single horizontal axis but there is no provision permitting fore and aft or lateral adjustment of the cutter.

It is also known from prior art hole drilling machines, such as shown in U.S. Pat. No. 3,017,935 issued Jan. 23, 1962 to S. W. Bilbraith et al, to mount an auger and its rotary drive motor on the end of an elevatable and laterally swingable boom by means of a gimbal but there is no adjustment of the auger fore and aft of the boom to provide ultra-precise location of the auger.

SUMMARY OF THE INVENTION

In accord with one aspect of the present invention, a machine is disclosed for cutting and removing a plug of turf from a golf putting green to make a new putting cup receiving hole and, if desired, for then inserting the removed turf plug back into an existing cup hole to fill it. The machine comprises a main frame which has a fore and aft extent and a first mounting means for securing the main frame on a vehicle such as a mower used for cutting the grass on the golf course greens. The first mounting means permits the main frame to be vertically raised and lowered relative to the vehicle and also permits the main frame to be pivoted relative to the vehicle about a first vertical axis. The machine also includes a first raise-lower means which is secured to the main frame for raising and lowering it relative to the vehicle. The machine also includes a subframe which is secured on the main frame by a second mounting means. The second mounting means permits pivotal movement of the subframe about a second horizontal axis and also permits fore and aft movement of the subframe relative to the main frame. The cutter for cutting the cylindrical turf plug is mounted on the subframe and a third mounting means is provided for securing the cutter on the subframe for vertical movement to raised and lowered positions relative to the subframe and for rotary movement relative to the subframe about a third axis. The cutter is secured to the subframe by a second raise and lower means which is energizable to move the cutter between its raised and lowered positions. A drive means is secured to the cutter for rotating it about the third axis. A plug ejection means, mounted on the subframe, is selectively operable to eject the turf plug.

Preferably the first raise-lower means includes a first hydraulic cylinder member which has a piston reciprocally mounted therein. The piston is connected to the main frame for raising and lowering it. The first hydraulic cylinder also constitutes the first vertical pivot axis about which the man frame can be pivoted.

Preferably the first mounting means includes a main bracket structure which is mounted on the vehicle. The main bracket has a pivot boss therein which receives the first hydraulic cylinder for sliding and rotational movement therein. Preferably the main bracket will comprise a first fixed bracket which is mountable on the vehicle and a second swivel bracket which is mounted on the main bracket for movement about a fourth horizontal axis.

In one embodiment of the invention, the bracket structure includes an indexing means for locating the swivel bracket either in a first predetermined angular position relative to the main bracket which will orientate the main frame and cutter in an operative hole digging position or a second predetermined angular position relative to the main bracket which will orientate the main frame in a desired service position. A first locking means is provided for securing the swivel bracket in either of the desired positions of angular adjustment.

In another embodiment of the invention, the swivel bracket may be located in any desired position of angular adjustment relative to the main bracket and a second locking means is provided for releasably securing the swivel bracket in any selected position.

In either embodiment the second raise and lower means comprises a second hydraulic cylinder and piston assembly. The piston is fixedly mounted on the upper portion of the subframe and the piston extends downwardly to support a drive means in the form of a hydraulically driven motor. The drive means includes a drive shaft which extends downwardly through the subframe lower portion and is drivingly connected to the cutter. The second hydraulic cylinder can be energized to lower the drive means and cutter relative to the subframe and into the ground. At the same time, the drive means will be energized to rotate the cutter to thus cut the turf plug.

The machine includes a turf plug ejection means for use when the turf plug is to be inserted into an old cup hole to fill it. The ejection means comprises a plug push plate which is mounted inside of the cylindrical cutter for up and down movement relative thereto; a thrust member which is mounted on the subframe for back and forth movement relative thereto; and a thrust transfer means which is connected in fixed relation between the thrust member and the turf plug push plate. As the turf plug is being cut, the plug push plate is allowed to float upwardly within the cutter. To eject the turf plug after it has been inserted into an old hole, a fourth locking means is provided to selectively secure the thrust member in a stationary position relative to the subframe when the cutter is in a lowered position. When the second raise-lower means is activated to move the cutter to the raised position, the plug push plate will remain stationary thus causing the turf plug inside of the cutter to be ejected as the cutter is withdrawn from the ground.

In summary, the invention herein disclosed provides a putter hole digging machine which can be mounted on a vehicle. The vehicle can be initially located in the general area where the cup hole is to be dug, and then while the machine is stationary, the main frame can be rotated about a first horizontal axis while the subframe can be moved fore and aft to accurately locate the cutter in position where the cup hole is to be dug. In addition, the subframe can be pivoted about a second generally horizontal transverse axis and about a third generally horizontal fore to aft axis which is at right angles to the second axis in order to vertically orientate the axis of the cutter so that the axis of the cup hole will be vertical despite the slope of the green on which the machine is resting.

BRIEF DESCRIPTION OF THE DRAWINGS

Referring to the drawings

DESCRIPTION OF THE PREFERRED EMBODIMENTS

Figure 1:
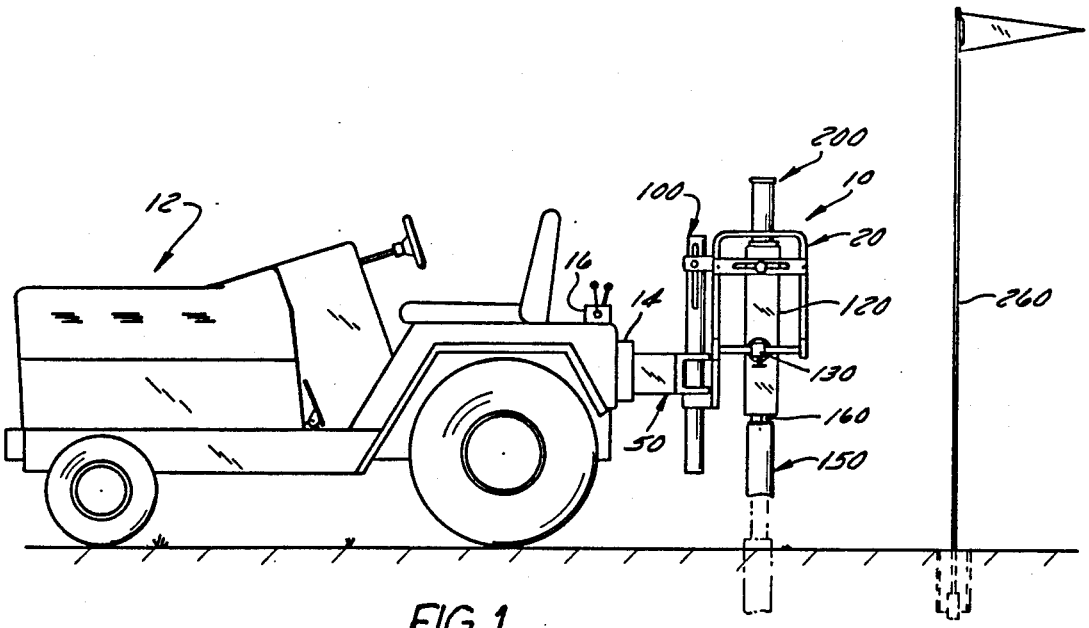
FIG. 1 is a side elevational view of a tractor having the putting cup hole digging machine mounted thereon shown with the tractor positioned on a golf course putting green.

Referring to FIG. 1, the putter cup hole digging machine 10 is shown mounted on a vehicle such as conventional tractor 12. In the alternative, the machine 10 could be mounted on a tractor of the type normally used for mowing the putting green or it could be self-propelled. The tractor 12 has a frame 14 onto which machine 10 is mounted and a hydraulic system 16 which includes a source of hydraulic pressure P (FIG. 16) for energizing the hydraulic components.

The basic components of the machine 10 include a main frame 20; a first mounting means 50 for securing the main frame 20 on the tractor 12; a first raise and lower means 100 for raising and lowering the main frame relative to the tractor; a subframe 120; a second mounting means 130 for securing the subframe 120 on the main frame 20; a cutter means 150 for cutting the turf plug 261; a third mounting means 160 for securing the cutter on the subframe 120; a second raise-lower means 200 secured to the cutter for raising and lowering the cutter relative to the subframe 120; a drive means 180 (FIG. 5) for rotating the cutter; and an ejection means 210 (FIG. 5) selectively operable to eject the turf plug from the cutter. These components will now be described in further detail.

The Main Frame

Figure 2:
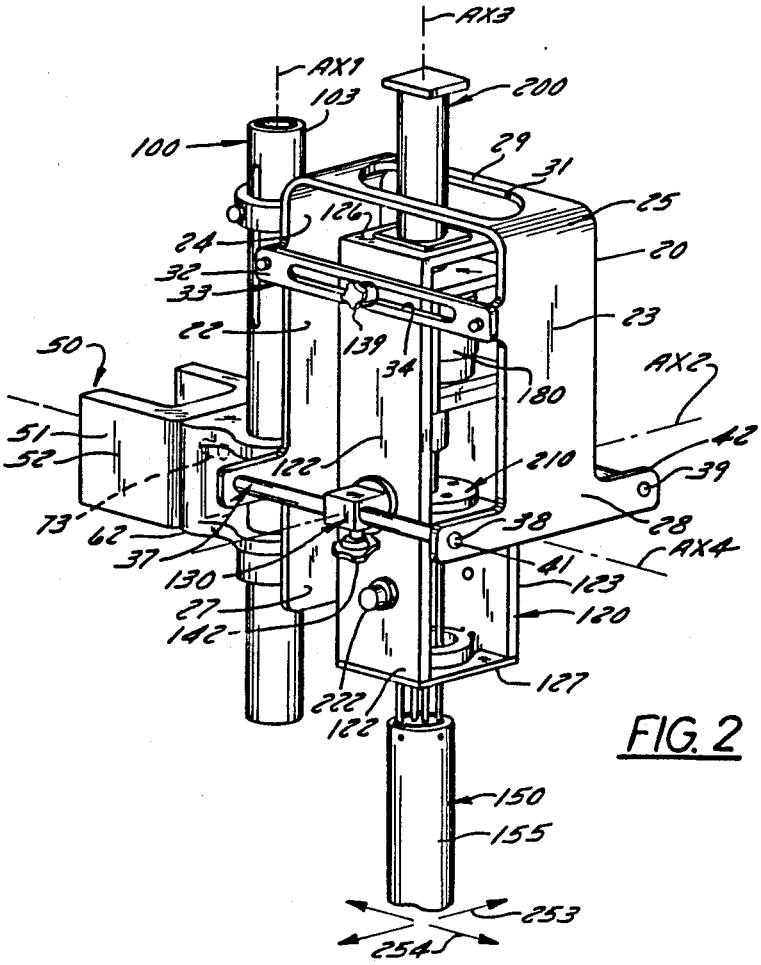
FIG. 2 is an isometric projection of the putting cup hole digging machine and its mounting bracket removed from the tractor.
Figure 4:
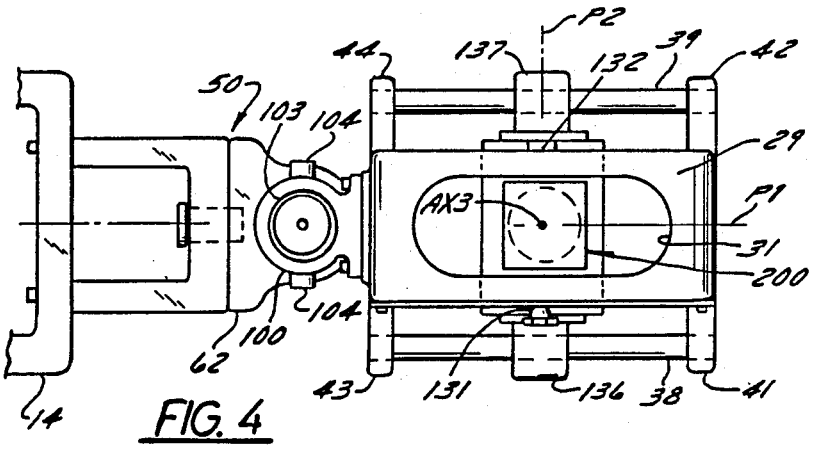
FIG. 4 is a top view of the machine shown in FIG. 3.
Figure 3:
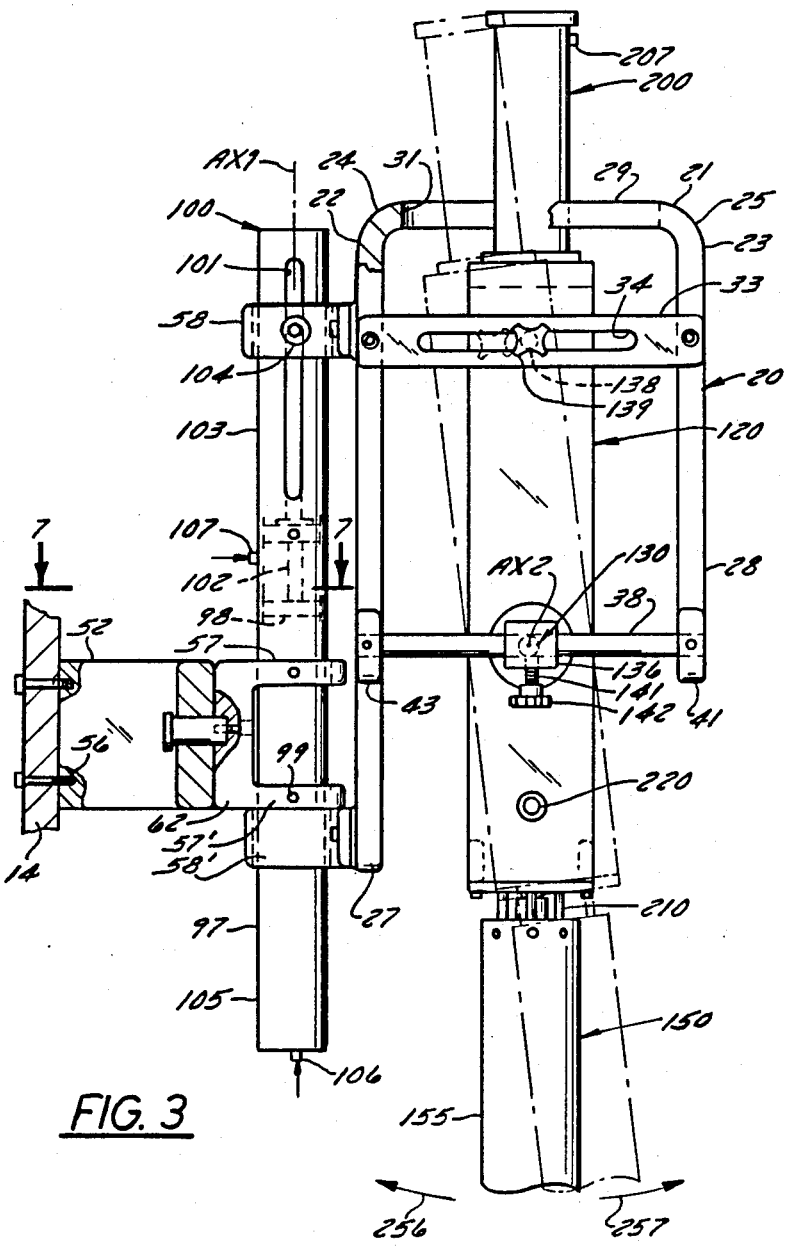
FIG. 3 is a side elevational view of the machine shown in FIG. 2 with dot-dash lines illustrating the angular adjustability of the subframe about a generally horizontal axis extending transversely to the fore to aft extent of the tractor.

The main frame 20, best shown in FIGS. 2, 3 and 4, comprises an inverted U-shaped member 21 having front and rear legs 22, 23 spaced apart to provide the main frame 20 with a fore and aft extent. The legs 22, 23 each have upper ends 24, 25 and lower ends 27, 28, respectively. The upper ends 23, 24 are connected together by a bight portion 29 having an elongated aperture 31 therein. An upper slide member 32, comprising a bracket 33 having an elongated slot 34 therein, is mounted between upper ends 24, 25 by any suitable means such as bolting or welding. A lower slide member 37, comprising a pair of spaced parallel rods 38, 39, is mounted between the lower ends 27, 28 of legs 22, 23. Preferably the legs 22, 23 have transversely projecting arms 41, 42, 43, 44 which have apertures therein to receive the ends of rods 38, 39. The main frame 20 may be cast as one piece or fabricated from components cut from metal plate stock.

Figure 15:
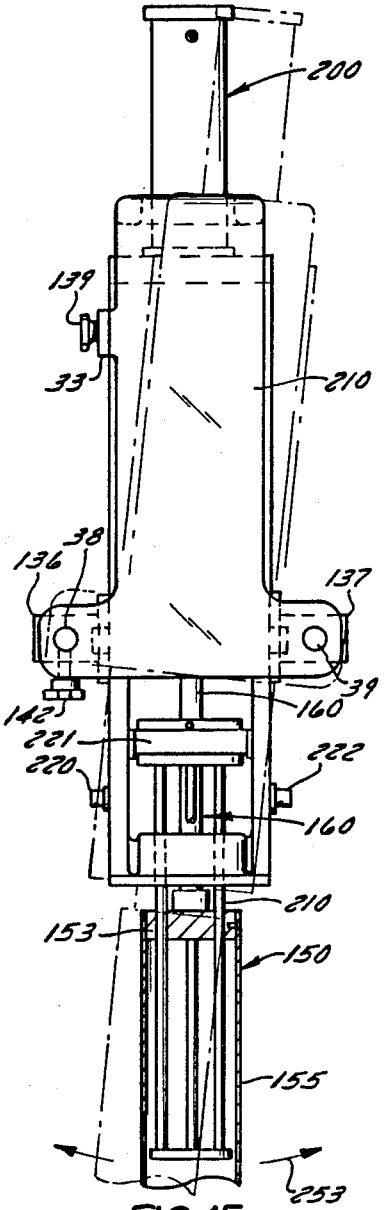
FIG. 15 is a rear elevational view of the putting cup hole digging machine shown in FIG. 12 with dot-dash lines illustrating the angular adjustability of the main frame about a generally horizontal fore and aft axis.
Figure 11:
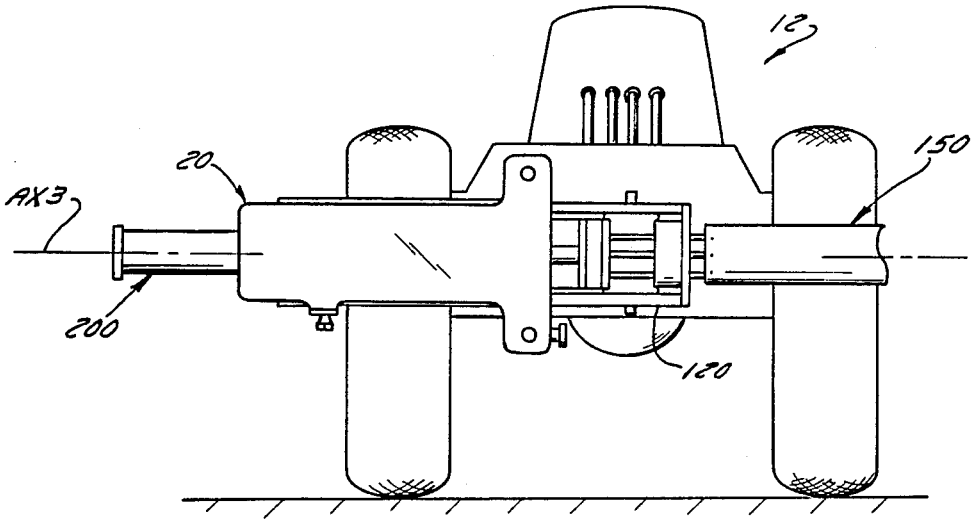
FIG. 11 is a rear elevational view of the machine mounted on a vehicle and orientated to a generally horizontal service position.

The various functions of the main frame 20 and the components it supports will be described in detail hereinafter, but by way of a general introductory summary it will be understood that the main frame 20 is mounted on the tractor by a first mounting means 50 which allows for pivotal movement thereof about a first vertical axis AX1 (FIG. 2). The main frame 20 supports a subframe 120 therein for fore and aft movement and for pivotal movement about a second horizontal axis AX2 (FIG. 2). The axis AX2 lies in a transverse vertical plane P2 (FIG. 4) that extends in a transverse direction through a third vertical axis AX3. The subframe 120 in turn supports a turf plug cutter 150 for vertical movement and for rotary movement about the third vertical axis AX3 (FIG. 2). The first mounting means 50 for connecting the main frame 20 to the tractor can take several forms. It may be designed to only releasably couple the main frame 20 to the tractor frame 14 in one fixed vertical position; or it may be designed to permit pivotal movement of the main frame 20 about a fourth horizontal axis AX4 (FIG. 2), which lies in a fore to aft vertical plane P1 (FIG. 4) which also extends through the third vertical axis AX3, to a service position such as shown in FIG. 11; or it may be designed to permit the main frame 20 to be rotated about axis AX4 to any one of a plurality of angular working positions as illustrated in FIG. 15 and be secured in such position. The first mounting means 50 will now be described in detail.

The First Mounting Means

The main frame 20 is secured to the frame 14 of tractor 12 by first mounting means 50 best shown in FIGS. 1–4 and 7–10. The first mounting means 50 will permit the main frame 20 to pivot laterally from side to side about vertical axis AX1. The first mounting means 50 includes a main bracket 51 secured to tractor frame 14 by bolts 56 (FIG. 3). The main bracket 51 also includes first hinge knuckle means 57, 57'. A second knuckle means 58, 58' are mounted on front leg 22 to provide a pivot boss for a first hydraulic cylinder 97 which also functions as a pivot pin for the main frame 20 as will be more fully described hereinafter.

Preferably the main bracket 51 will comprise an assembly of a U-shaped first fixed bracket 52 rigidly secured to the tractor frame 14 and a second swivel bracket 62 which includes the first hinge knuckle means 57, 57' in order to provide for pivotal movement of the main frame 20 about the horizontal axis AX4 (FIG. 2). Two embodiments of the bracket are disclosed which provide for relative pivotal movement between the first fixed bracket 52 and second swivel bracket 62 about horizontal axis AX4.

In the first embodiment, best shown in FIGS. 3, 7, 9, and 10, the first fixed bracket 52 has a cross web 53 having a pivot pin receiving aperture 54 therethrough. The second swivel bracket 62 has a cross web 63 having a pivot pin receiving recess 64 therein. One end 67 of a master pivot pin 66 is secured in recess 64 by a cap screw 68. The other end of pin 66 is retained in aperture 54 by an enlarged washer 71 and a cap screw 72. The swivel bracket 62 is secured to the fixed bracket 52 by a first lock means comprising spaced apart cap screws 73, 74 which are threaded into a first set of internally threaded apertures 79. Preferably an indexing means 76 is provided for locating the swivel bracket 62 in one or more predetermined angular positions relative to the fixed bracket 52. For example, it may be desired to permit the main frame 20 to be pivoted to move the axis AX3 from a vertically orientated working position shown in FIG. 2 to a horizontal service position shown in FIG. 11.

With specific reference to FIGS. 7–11, the indexing means 76 comprises a pair of dowel pins 77, 78 which slidably fit into a first set of vertically aligned dowel receiving apertures 81 or a second set of horizontally aligned dowel receiving apertures 82. The master pivot pin 66 projects past cross web 53 a distance that is greater than the distance dowel pins 77, 78 project from cross web 63. Thus when cap screws 73, 74 are removed, the swivel bracket 62 may be moved axially along master pivot pin 66 to the position shown in FIG. 10 where dowel pins 77, 78 are clear from contact with web 53. The swivel bracket 62 and main frame 20 may then be rotated 90° about master pin 66 so that dowels 77, 78 align with the set of horizontal apertures 82. The swivel bracket 62 is then pushed toward fixed bracket 52 to insert dowels 77, 78 in apertures 82. Preferably a second set of internally tapped apertures 83 will be provided to receive cap screws 73, 74 which constitute a first lock means to lock the swivel bracket in the service position where axis AX3 is horizontally disposed as shown in FIG. 11.

The second embodiment which will permit infinite angular adjustment of swivel bracket 62 relative to fixed bracket 52 is shown in FIGS. 12–15. In this second embodiment, swivel bracket 62 has a projecting stub shaft 86 which is rotatably received in a mating aperture 87 in fixed bracket 52. The stub shaft 86 is provided with an internally threaded aperture 88.

A retainer washer 89, which has a larger diameter than the diameter of stub shaft 86 and aperture 87, is fastened to the end of stub shaft 86 by cap screw 91 to retain shaft 86 in aperture 87. A second locking means in the form of threaded shaft 92 and hand wheel 93 is provided to lock the swivel bracket 62 in any selected position. The shaft 92 is screwed into a suitable internally threaded bore in bracket 52 and the hand wheel 93 will permit convenient tightening and loosening thereof. Turning of shaft 92 will force the end thereof into contact with surface 94 of shaft 86 to lock the swivel bracket 62 in any desired position of angular adjustment. If desired, index indentations (not shown) could be provided in the peripheral surface 94 of shaft 86 to receive the end of shaft 92. Other equivalent structure for providing rotational movement of swivel bracket 62 about axis AX4 to any angular position will be apparent to those skilled in the art.

The First Raise-Lower Means

A first raise-lower means 100 for raising and lowering the main frame 20 relative to tractor 12 is best shown in FIGS. 2 and 3, and comprises an assembly of a first double-acting hydraulic cylinder member 97 and piston 98. The cylinder 97 is nonmovably secured in first pivot knuckle means 57, 57' by set screws 99 and rotatably and slidably received in the second pivot knuckle means 58, 58' carried by the main frame 20. The cylinder 97 has a vertical upper extension 103 which is provided with diametrically opposed elongated slots 101 therein, only one of which appears in FIG. 3 and a lower portion 105. The piston rod 102 extends into the cylindrical extension 103 and is provided with a connecting means which includes an internally tapped aperture at its upper end, not shown. The connecting means also includes mounting bolts 104 which are extended through slots 101 and threaded into the aperture in piston rod 102. The cylinder is provided with hydraulic fluid ports 106, 107. Admission of hydraulic fluid through port 106 will raise main frame 20 with hinge knuckles 58, 58' sliding along the outer surface of cylinder 97. Similarly, admission of hydraulic fluid through port 107 will lower main frame 20. The complete function of the hydraulic system will be described hereinafter. The cylinder 97 constitutes a pivot pin which defines the first generally vertical pivot axis AX1 about which the main frame 20 can pivot.

The Subframe

A subframe 120 is mounted on the main frame 20. The function of the subframe 120 is to support a turf plug cutter means 150, a drive means 180 for rotating the cutter and a turf plug ejecting means 210, all of which will be described hereinafter.

Figure 5:
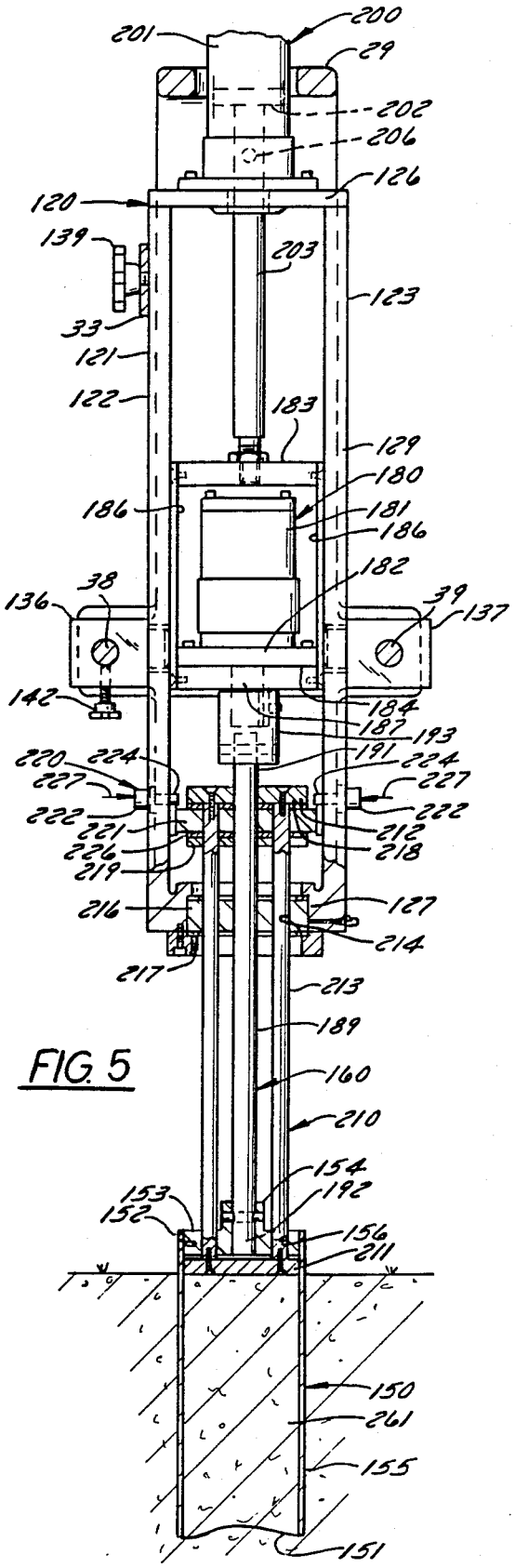
FIG. 5 is an end elevational view of the machine shown in FIG. 2 with some parts shown in section and the cutter in the ground.
Figure 6:
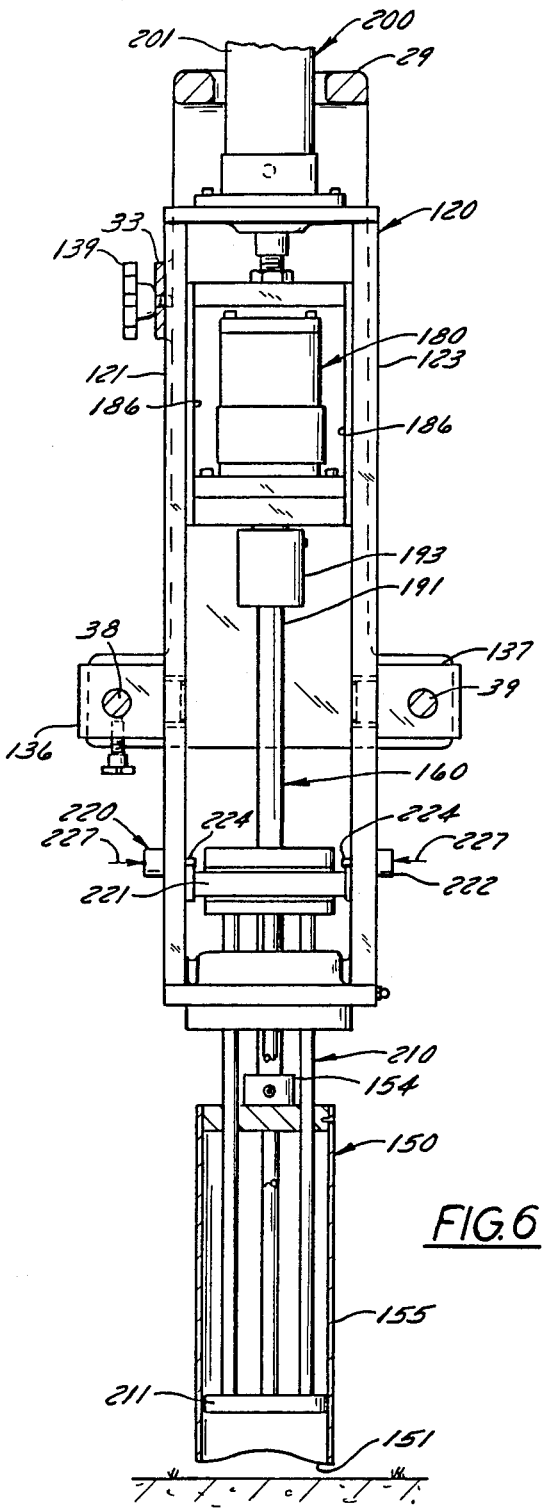
FIG. 6 is an end elevational view of the machine shown in FIG. 2 with the cutter above the ground.
Figure 7:
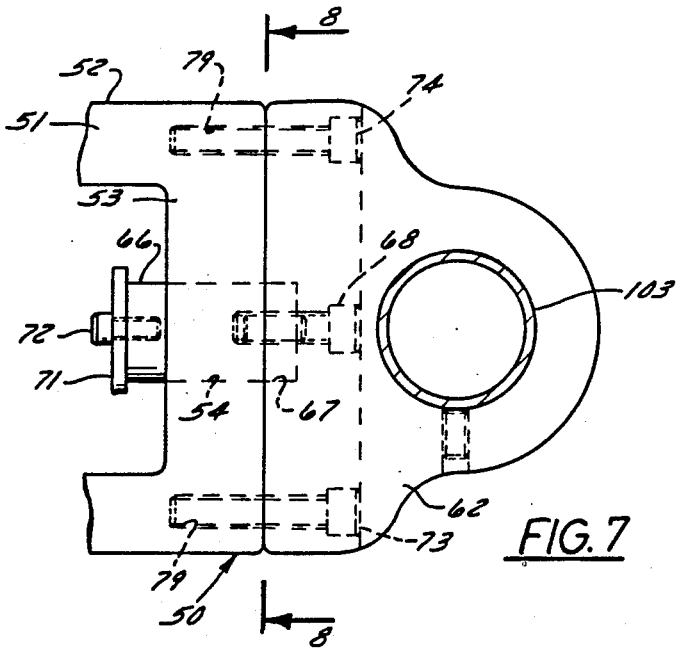
FIG. 7 is a partial cross-sectional view of the fixed and swivel mounting brackets taken along line 7—7 of FIG. 3.
Figure 10:
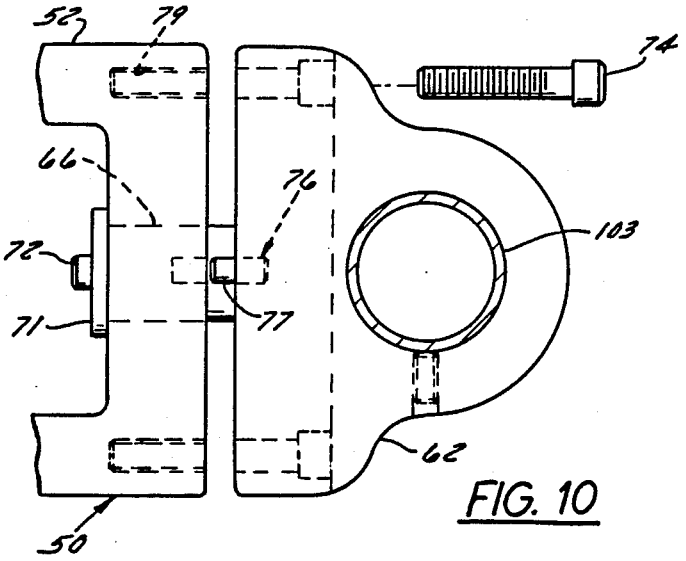
FIG. 10 is a view of the brackets shown in FIG. 7 with the swivel bracket separated from the fixed bracket.

The subframe 120 best appears in FIGS. 2, 5 and 6 and includes a vertically elongated housing 121 formed by spaced apart side walls 122, 123, top wall 126 constituting an upper portion and a bottom wall 127 constituting a lower portion. The subframe 120 also includes an intermediate portion 129 located between the upper and lower portions. The subframe 120 is mounted on the main frame 20 by a second mounting means 130 which will now be described.

The Second Mounting Means

The second mounting means 130 includes a lower pivot element in the form of a trunnion member 131 (FIG. 4) projecting from side wall 122 and a trunnion member 132 projecting from side wall 123. The trunnion members 131, 132 are in axial alignment and define the transversely extending second horizontal axis AX2 about which subframe 120 is pivotable. The trunnion 131 is pivotally mounted in a trunnion support member which comprises a slide block 136 having a bore through which rod 38 slidably passes. Trunnion 132 is similarly mounted in a slide block 137 carried by rod 39. The slide blocks 136, 137 slide on rods 38, 39 to permit the subframe 120 to be moved fore and aft relative to main frame 20. The slide block 136 is provided with an internally threaded aperture into which shaft 141 of hand wheel 142 is threaded. The assembly 141, 142 constitutes a third lock means and locks the subframe 120 in any fore and aft position of adjustment.

The second mounting means also includes a projecting upper pivot element in the form of threaded stud 138 which projects from the subframe side wall 122 and through slot 34. A hand wheel 139 is threaded on stud 138 and constitutes a fifth locking means and secures the subframe 120 in any desired angular position of adjustment relative to the second horizontal axis AX2.

The Cutter

A turf plug cutter means 150 is best shown in FIG. 5. Cutter means 150 includes a hollow cylindrical cutter 155. One end 151 of the cutter 155 is contoured and sharpened to form a cutting end that penetrates into the turf and soil of the putting green. The other end 152 of the cutter 155, the drive end, is closed by a cutter retainer 153. The retainer 153 includes a hub 154 for connection to the cutter drive means 180 and a plurality of stripper rod receiving apertures 156, the function of which will be described hereinafter.

The Third Mounting Means

The Drive Means

As the third mounting means 160 and the cutter drive means 180 are closely related structurally, they will be described together. The third mounting means 160 secures the cutter means 150 on the subframe 120 for vertical movement relative to the subframe between the raised and lowered positions shown in FIGS. 1, 5 and 6 and also for rotary movement about the third axis AX3. Preferably the third mounting means 160 for securing the cutter means 150 on the subframe 120 and the drive means 180 will be constituted by a single integrated motor and drive shaft assembly although separate structures could be provided if desired.

More specifically, the drive means 180 includes a source of rotary power, such as hydraulic motor 181, mounted within a vertically slidable housing 182. The housing 182 has top, bottom and side walls 183, 184, 186. The housing 182 is dimensioned to permit it to slide up and down within the cavity defined by subframe side walls 122, 123. The motor 181 is mounted to bottom wall 182 and has a power shaft 187 which projects down through the bottom wall. A drive shaft 189 for mounting and rotating the cutter 155 is provided that has a power input end 191 and a power output end 192. The input end 191 of shaft 189 is connected to motor shaft 187 by a coupling 193 and the output end 192 is secured in hub 154. The drive shaft 189 passes freely through the bottom wall 127 of subframe 120 and serves two functions. The first function is to rotate the cutter 155. The second function is to support the cutter 155 from the en 192 thereof and thus constitutes the third mounting means. As the motor housing 182 is raised and lowered by the second raise-lower means 200, which will now be described, the drive shaft 189 associated therewith will also move up and down and thus raise and lower cutter means 150.

The Second Raise-Lower Means

Figure 16:
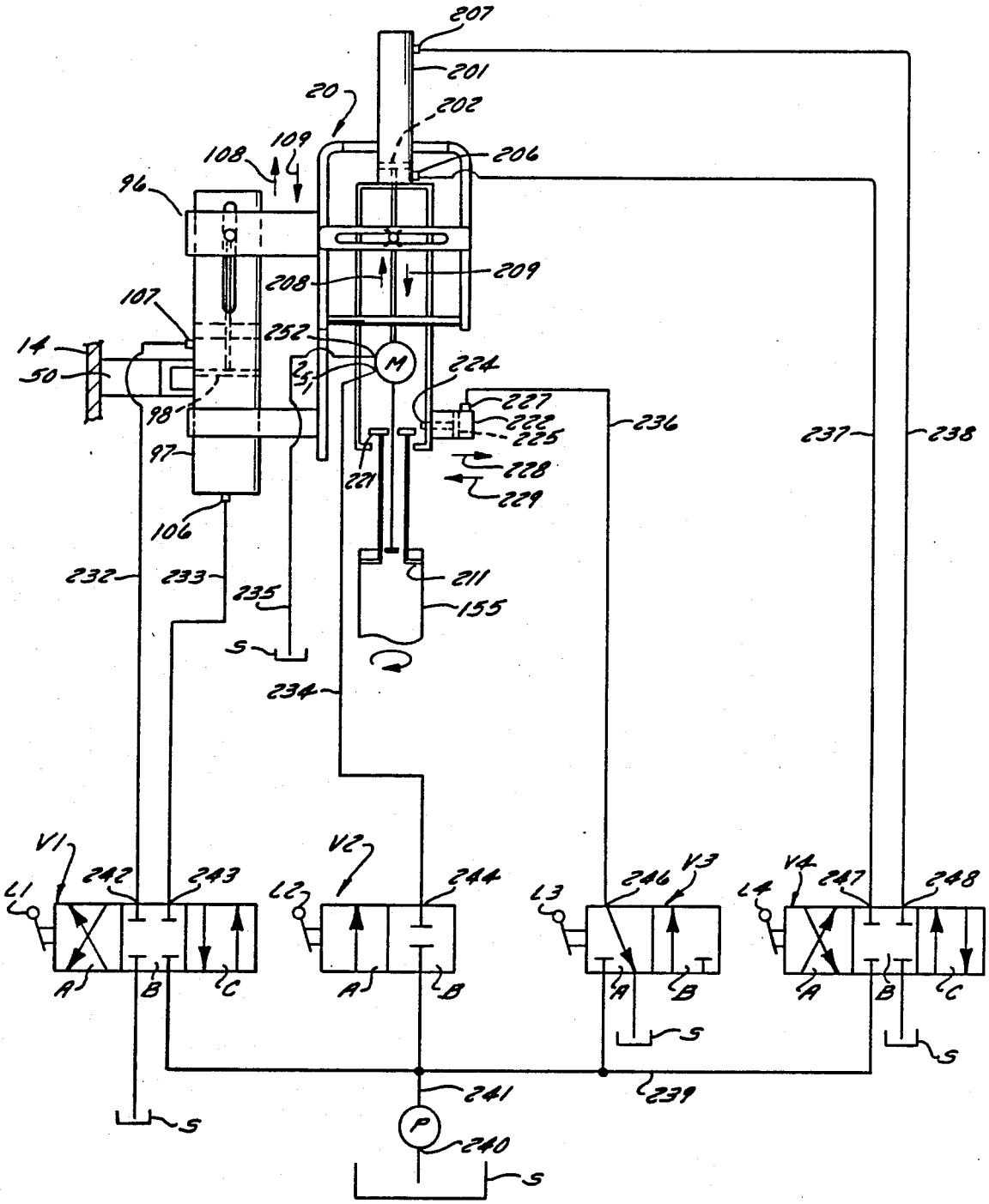
FIG. 16 is a schematic circuit showing the hydraulic system for the hydraulic components of the machine.

A second raise-lower means 200 is secured to the cutter means 150 for moving it between raised and lowered positions relative to the subframe 120 shown in FIGS. 5 and 6, respectively. More specifically and with reference to FIG. 5, the second raise-lower means 200 includes a second double-acting hydraulic cylinder 201 and piston 202. The cylinder 201 is secured to the top wall 126 of subframe 120 and projects upward through the elongated aperture 31 in main frame 20. A piston rod 203 is connected to piston 202 and projects downward through upper wall 126. The lower end of piston rod 203 is threaded and screwed into a threaded aperture in the top wall of 183. The cylinder 201 has hydraulic fluid inlet ports 206, 207 (FIGS. 3, 16). When fluid is introduced into port 206 the cutter 155 is raised, and when fluid is introduced into port 207 the cutter will be lowered as will be more fully explained hereinafter.

The Turf Plug Ejection Means

A turf plug ejection means 210 (FIGS. 5 and 6) is mounted on the subframe 120 and is operable to either permit the turf plug 261 to remain in the cutter 155 as it is withdrawn from a new hole or to cause the turf plug 261 to remain in an old hole (when placed therein to plug the hole) as the cutter 155 is removed from the ground. The turf plug ejection means includes a turf plug push plate 211 mounted inside of the cylindrical cutter for up and down movement between the driving end 152 and cutting end 151 of the cutter 150. The ejection means also includes a thrust member assembly 212, having spaced apart upper and lower plates 218, 29, which is slidably mounted on the subframe 120 for reciprocal movement between bottom wall 127 of the subframe and the bottom wall 184 of housing 182. The ejection means further includes a thrust transfer means in the form of four rods 213 which are connected between the thrust member 212 and push plate 211. The rods 213 slidably pass through apertures 214 in a rotating guide plate 216 which is rotatably mounted in bottom wall 127 by thrust bearings 217. The rods 213 also slidably pass through apertures 156 in the retainer 153. The lowermost ends of the rods 213 are secured to push plate 211 by countersunk cap screws. The push plate 211, rods 213, plate 216 and thrust member 212 rotate as a unit along with the drive haft 189 and cutter 155.

The turf plug ejection means also includes a lockout means 220 which comprises a nonrotatable plate 221 which is mounted between subframe side walls 122, 123 for vertical up and down sliding movement and a pair of single-acting lockout rams 222 mounted on side walls 122, 123. The rams 222 include a fourth locking means in the form of lock pins 224, which are normally biased to a retracted position to permit the thrust member 212 and plate 221 to freely slide vertically up and down relative to the subframe 120. Plate 221 is positioned between the upper and lower plates 218, 219 and has a center aperture to permit passage of the drive shaft 189 and the thrust rods 213. Antifriction bearings 226 are mounted on each side of lockout plate 221 to permit the upper and lower plates 218, 219 to freely rotate with rods 213. Each lockout ram 222 has a fluid inlet port 227. Admission of fluid into ports 227 will cause pins 224 to be projected into the space between the subframe side walls 122, 123 above the top surface of lockout plate 221 and prevent it from traveling vertically past pins 224. The functioning of the lockout plate 221 and the plug ejection means 210 will be further described hereinafter.

The Hydraulic System

The hydraulic system is best shown in FIG. 16. The system includes a hydraulic fluid containing sump S and a high pressure hydraulic pump P which preferably are part of the tractor hydraulic system 16. The intake 240 of pump P is connected to the sump S and the output 241 of pump P is connected by conduit 239 to hydraulic control valves V1, V2, V3 and V4. Valves V1 and V4 are three-position slide valves actuated by levers L1 and L4, respectively. Valves V2 and V3 are two-position slide valves actuated by levers L2 and L3, respectively. All of the valves V1–V4 are illustrated in their off positions wherein no high pressure hydraulic fluid is allowed to flow to any of the hydraulically actuated components of the putting cup hole digging machine.

Valve V1 includes outlet ports 242 and 243. Outlet port 242 is connected by conduit 232 to inlet port 107 of cylinder 97. The outlet port 243 of valve V1 is connected by conduit 233 to the inlet port 106 of cylinder 97. Valve V2 has a single outlet port 244 which is connected by conduit 234 to the inlet port 251 of motor M. The outlet port 252 of hydraulic motor M is connected by conduit 235 which returns hydraulic fluid to sump S. Valve V3 has a single output port 246 which is connected by conduit 236 to the port 227 of cylinder 222. Valve V4 includes outlet ports 247, 248. The outlet port 247 of valve V4 is connected by conduit 237 to the port 206 of cylinder 201. The other outlet port 248 of valve V4 is connected by conduit 238 to the port 207 of cylinder 201.

The hydraulic system operates as follows. To raise the main frame 20, lever L1 of valve V1 is moved to place valve V1 in position C. In position C, high pressure fluid will flow through conduit 233 to move piston 98 in the direction of arrow 108 (FIG. 16). During raising movement of piston 98, hydraulic fluid is returned to sump S through conduit 232. When it is desired to lower the main frame 20, valve V1 is placed in position A wherein high pressure hydraulic fluid is passed through conduit 232 to force piston 98 in a downward direction, thus moving the main frame 20 in the direction of arrow 109. With valve V1 in position A, hydraulic fluid which is forced out of cylinder 97 returns to sump S via conduit 233.

To rotate cutter 155, motor M is actuated by moving valve V2 to position A thus allowing high pressure hydraulic fluid to flow through conduit 234, through motor M, and through conduit 235 back to sump S.

To energize the stripper lockout ram 222, lever L3 is moved to place valve V3 in position B wherein high pressure hydraulic fluid will flow through conduit 236 to move piston 225 in the direction of arrow 229. Lockout ram 222 is a single acting ram and is normally spring biased to the retracted position shown in FIG. 16. When valve V3 is in position A, conduit 236 is connected to sump S thus allowing the bias of the return spring, not shown, to maintain the piston 225 in the position shown which withdraws pin 224 from contact with lockout plate 221.

In order to raise the cutter 155 and motor M relative to the subframe 120, lever L4 is moved to place valve V4 in position C wherein high pressure fluid will flow through conduit 237 to force piston 202 in the direction of arrow 208. As piston 202 is raised, hydraulic fluid is vented through conduit 238 back to sump S. If it is desired to lower the cutter 155 and motor M relative to subframe 120, lever L4 will be moved to place the valve V4 in position A wherein high pressure hydraulic fluid will flow through conduit 238 to force piston 202 downward in the direction of arrow 209. As piston 202 is forced downwardly, hydraulic fluid in the lower portion of cylinder 201 will exit via conduit 237 and return to sump S.

If desired, it would be possible to combine the various valves so that two functions could be accomplished by means of actuation of one valve. For example, valve V2 and valve V4 could be combined so that actuation of a single lever would both energize motor M to rotate the cutter 155 and simultaneously move the cutter assembly downward relative to the subframe 120 in the direction of arrow 209.

Operation

The operation of the putting cup hole digging machine shown in FIGS. 1 through 11 and 16 is as follows. Tractor 12 is positioned on the putting green with the fore to aft extent thereof located parallel to the uphill-downhill direction in which the green slopes so that the fore to aft vertical plane P1 in which cutter axis AX3 lies will be at a true vertical orientation with the cutter 155 in the general vicinity of where the putter cup hole is to be dug. If the green is level, the location of the fore to aft extent of the tractor is of no consequence. During travel and initial positioning of the tractor, the cutter 155 will be located in an elevated position as shown in FIG. 1. The exact location for the putting cup receiving hole is marked on the green by the operator and lever L1 is moved to place valve 1 to position A to allow main frame 20 to lower in the direction of arrow 109 until cutter 150 is just above the surface of the grass as shown in FIG. 6. The final positioning of the cutter 155 to where the hole is to be dug is obtained by swinging the main frame 20 about pivot axis AX1 which permits the cutter to follow the arcuate path of travel indicated by line 253 in FIG. 2. Hand wheels 139 and 142 are loosened thus allowing the subframe 120 to be moved in a fore and aft direction as required to move the cutter along line 254 of FIG. 2. If the transverse vertical plane P2 in which axis AX3 lies is not precisely vertical, then the subframe 120 will be pivoted about horizontal axis AX2 in the direction of arrow 256 or 257 shown in FIG. 3 in order to achieve a true vertical orientation. Axis AX3 must be at a true vertical orientation in both fore to aft and transverse planes P1 and P2 regardless of the slope of the green in order that the axis of the putter cup and flag stick 260 (FIG. 1) will always extend in a vertical direction. With the cutter accurately positioned and axis AX3 orientated vertically, the operator will move valve V2 to position A whereby motor M will rotate the cutter 155. With cutter 155 rotating, lever L4 will be moved to place valve V4 in position A which will slowly force the now rotating cutter 155 from the position shown in FIG. 6 into the ground until the position shown in FIG. 5 is reached wherein a plug of turf 261 will exist within the cutter 155. As the rotation of the cutter 155 and the downward pressure thereon exterted by piston 202 never stops, the root system within the plug will not be severed and a continuous unbroken turf plug will exist inside of cutter 155. Lever L2 is then actuated to return valve V2 to position B to deenergize motor M and stop rotation of the cutter. When cutter rotation stops, the soil of the plug will adhere to the inside of the cutter. Lever L4 is then actuated to move valve V4 to position C which will cause the cutter to be withdrawn from the ground at which time the soil will cleanly break at the bottom of the cutter 155 to provide a turf plug of exact length. During the cutting action, the push plate 211 and the rods 213 are free to slide axially and thus as the cutter 155 moves into the ground, the push plate 211 moves upwardly within the cutter until it bottoms out against cutter retainer 153. This will ensure that precisely the same depth of putter cup receiving hole will be dug each time.

The main frame 20 is then pivoted laterally about axis AX1 to move the cutter 155 away from above the new hole. The operator then inserts the putter cup and moves the tractor into the general vicinity of the old hole. The above described cutter locating procedure is again followed to accurately position the cutter with the turf plug therein over the old hole which must now be filled with the turf plug. When accurate alignment has been achieved, valve V4 will be moved to position A to lower the cutter down into the old hole until the turf plug is fully inserted with the push plate 211 performing a tamping function. When this is accomplished, lever L3 is actuated to move valve V3 to position B wherein pin 224 is moved in the direction of arrow 229 of FIG. 16 into position above lock plate 221 to prevent its vertical movement. Lever L4 is then actuated to move valve V4 to position C causing piston 202 to move up in the direction of arrow 208 of FIG. 17. As piston 202 rises, the cutter 155 is withdrawn from the hole. The push plate 211 will remain stationary at ground level pressing against the top of plug 261 because lockout pin 224 is engagement with the top surface of lockout plate 221. Thus cutter 155 is withdrawn from the ground but the turf plug is forced to remain in the hole by push plate 211.

Figure 12:
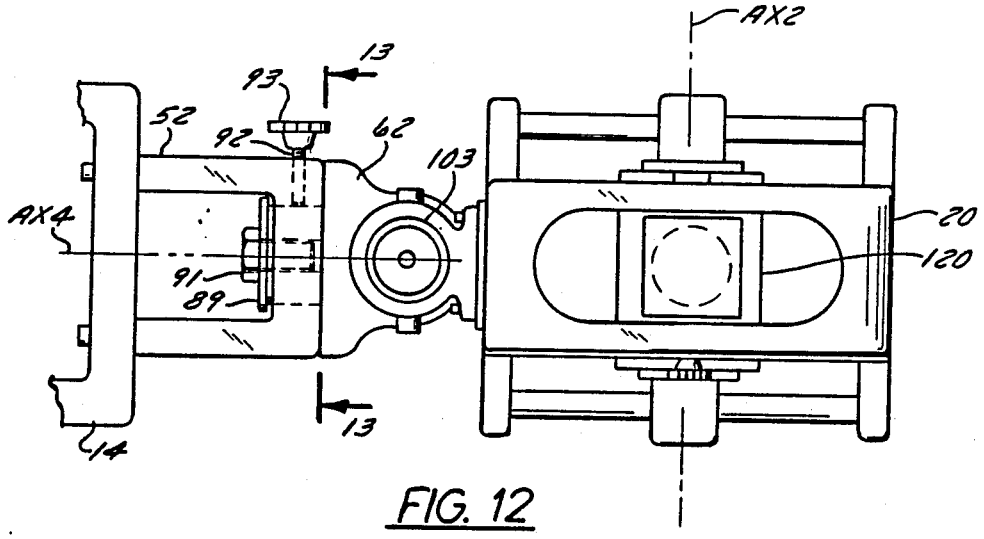
FIG. 12 is a top elevational view of the machine shown in FIG. 4 and showing another embodiment of the fixed and swivel brackets for mounting the machine on the vehicle.
Figure 13:
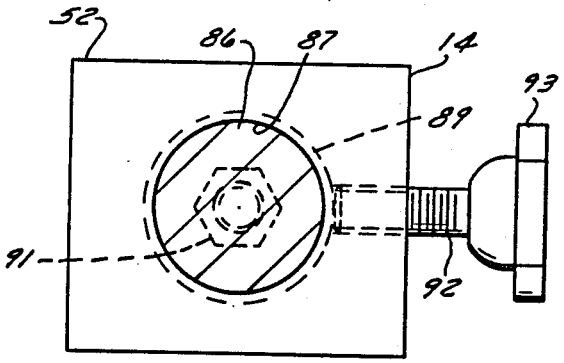
FIG. 13 is a sectional view of the fixed bracket taken along line 13—13 of FIG. 12.
Figure 14:
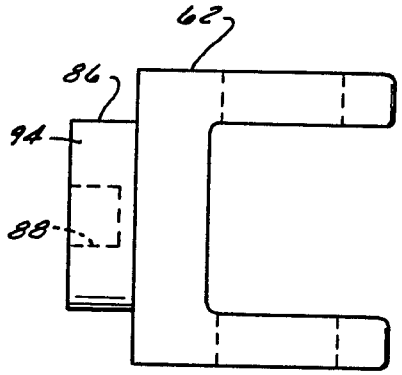
FIG. 14 is a side elevational view of the swivel bracket shown in FIG. 12.

In the embodiment shown in FIGS. 13–16, the operator need not be concerned that the fore to aft extent of the tractor be parallel to the uphill-downhill direction in which the green slopes. The tractor can be orientated in any position on a sloping green because of the infinite adjustment which is permitted by rotating the main frame 20 about axis AX4 shown in FIGS. 2 and 12 to orientate plane P1 and axis AX3 at true vertical. With reference to FIG. 12, hand wheel 93 is loosened to permit swivel bracket 62 to be rotated to any angular position relative to fixed bracket 52 to assure that the fore to aft plane P1, in which axis AX3 of the cutter 150 lies, is in a true vertical position. When the vertical position of the cutter 150 is achieved, hand wheel 93 is tightened to lock the main frame 20 in such position. Similarly hand wheel 139 is loosened to permit the subframe 120 to be rotated about axis AX2 to assure that the transverse plane P2 (which is at right angles to the fore to aft plane P1) in which axis AX3 lies is at a true vertical orientation.

Figure 8:
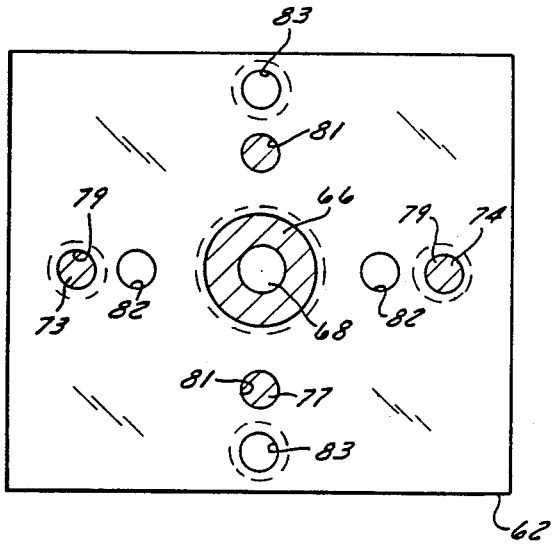
FIG. 8 is a sectional view of the fixed bracket taken along the line 8—8 of FIG. 7.
Figure 9:
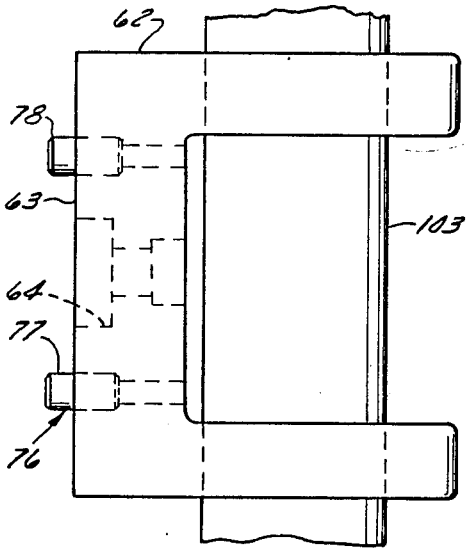
FIG. 9 is a side elevational view of the swivel bracket shown in FIG. 7.

The main frame 20 can also be rotated 90° about axis AX4 to place the entire assembly into the service position as shown in FIG. 11 wherein the axis AX3 is in a generally horizontal position. As will be noted, this places the cutter 155 at a convenient height for servicing. In the first embodiment of FIGS. 1–11, the cap screws 73, 74 shown in FIG. 8 are removed and the entire main frame 20 is moved away from the tractor which is permitted by the main pivot pin 66 sliding relative to the fixed bracket 52 to the position shown in FIG. 11 wherein dowel pins 77 and 78 are free from engagement with their corresponding apertures in bracket 52. The main frame and swivel bracket may then be rotated about axis AX4 to the position shown in FIG. 11. The entire assembly is then pushed forward toward the tractor so that dowel pins 77, 78 will engage in dowel pin receiving holes 82 in fixed bracket 52. Cap screws 73, 74 are then inserted in threaded apertures 83 to lock the hole digging machine in the service position shown in FIG. 11.

In the embodiment of FIGS. 13–16, when the hole digging machine has been moved to the service position shown in FIG. 12, hand wheel 93 is tightened to lock the unit in the service position.

In the embodiment of FIGS. 1–11, enlarged washer 71 will prevent total removal of the unit from the fixed bracket 52 during rotation around axis AX4. In the embodiment of FIGS. 12–16, enlarged washer 89 will similarly prevent removal of the entire unit from the fixed bracket 52 during rotation around axis AX4.

From the foregoing it will be appreciated that my invention provides a vehicle mounted machine for cutting and removing a plug of turf of a precise length with the root system intact to create a new putting cup receiving hole in a golf putting green and, if desired, for reinserting the newly cut turf plug into the old cup hole to close it.

What is claimed is:

1. A machine for cutting and removing a plug of turf from a golf putting green to make a new putting cup hole and, if desired, for inserting the turf plug into an existing cup hole to fill it comprising a main frame (20) having a fore and aft extent;

a first mounting means (50) for securing said main frame on a vehicle for vertical raising and lowering movement relative to said vehicle, and pivotal movement relative to said vehicle about a first vertical axis (AX1);

a first raise-lower means (100) secured to said main frame for raising and lowering said main frame relative to said vehicle means;

a subframe (120);

a second mounting means (130) for securing said subframe on said main frame for pivotal movement about a second horizontal axis (AX2), and fore and aft movement relative to said main frame;

a cutter means (150) for cutting said turf plug;

a third mounting means (160) for securing said cutter means on said subframe for vertical movement to raised and lowered positions relative to said subframe; and rotary movement relative to said subframe about a third axis (AX3);

a second raise-lower means (200) secured to said cutter means for moving said cutter means to said raised and lowered positions;

a drive means (180) secured to said cutter means for rotating said cutter means about said third axis; and a plug ejection means (210) mounted on said subframe and selectively operable to eject said plug.

2. A machine according to claim 1 wherein:

said first raise-lower means includes a first hydraulic cylinder member (97) having a piston member (98) reciprocally mounted therein; and said first mounting means (50) includes a main bracket (51) mountable on said vehicle;

said main pivot constituting said first vertical pivot axis (AX1) comprises said first hydraulic cylinder (97) mounted on said bracket, and a pivot boss means (58, 58') secured to said main frame, with said first hydraulic cylinder mounted in said pivot boss means for sliding and rotational movement relative thereto.

3. A machine according to claim 2 wherein said main bracket (51) comprises a first fixed bracket (52) mountable on said vehicle and a second swivel bracket (62) mounted on said fixed bracket for movement about a fourth horizontal axis (AX4).

4. A machine according to claim 3 wherein said brackets include:

indexing means (76) for locating said swivel bracket either in a first predetermined angular position relative to said main bracket which will orientate said main frame in an operative hole digging position or a second predetermined angular position relative to said main bracket which will orientate said main frame in a desired service position; and a first locking means (73, 74) for releasably securing said swivel bracket in either desired position of angular adjustment relative to said main bracket.

5. A machine according to claim 3 wherein said brackets have a second locking means (93) for releasably securing said swivel bracket (62) in any desired position of angular adjustment relative to said main bracket.

6. A machine according to claim 2 wherein:

said first hydraulic cylinder (97) includes a lower portion (105) and an upper extension (103);

said pivot boss means includes a lower pivot boss (58') mounted for rotational movement about said first hydraulic cylinder lower portion and an upper pivot boss (58) mounted for rotational movement about said first hydraulic cylinder upper extension to permit lateral swinging movement of said main frame (20) about said first pivot axis (AX1); and a connecting means (102, 104) for securing said first piston (98) to said main frame whereby reciprocal movement of said first piston in said first cylinder will raise and lower said main frame.

7. A machine according to claim 1 wherein said second mounting means (130) for mounting said subframe (120) on said main frame (20) includes a a trunnion member (131, 132) mounted on one of said frames, and a trunnion support member (136, 137) mounted on the other of said frames to permit angular adjustment of said subframe relative to said main frame about said second horizontal axis (AX2).

8. A machine according to claim 7 wherein one of said members (136, 137) is mounted on said main frame for fore and aft movement relative thereto.

9. A machine according to claim 8 wherein said second mounting means includes a third locking means (142) for locking said subframe in any fore and aft position of adjustment.

10. A machine according to claim 1 wherein:

said subframe (120) includes spaced apart upper and lower portions (126, 127);

said drive means (180) is mounted on said subframe for vertical movement toward and away from said upper and lower portions;

said third mounting means (160) includes, a drive shaft (189) having a power output end (192) and a power input end (191);

said drive shaft output end (192) projecting from said subframe lower portion and drivingly connected to said cutter means (155); and said drive shaft input end connected to said drive means (180); and said second raise-lower means (200) is secured to said drive means and operative when energized to raise and lower said drive means, associated drive shaft and cutter means.

11. A machine according to claim 10 wherein:

said second raise-lower means (200) includes second hydraulic cylinder and piston members (201, 202), one of said members (201) fixedly mounted on said subframe upper portion (126), the other of said members (202) being connected to said drive means (180).

12. A machine according to claim 1 wherein:

said cutter means (150) includes a hollow cylindrical cutter member (151) having a drive end (152) and a cutting end (151); and said plug ejection means (210) includes, a plug push plate (211) mounted inside of said cylindrical member for up and down movement between said drive and cutting ends;

a thrust member (212) mounted on said subframe for back and forth movement relative thereto;

a thrust transfer means (213) connected in fixed relation between said thrust member and said plug push plate; and an actuating means (222) for selectively locking said thrust member and associated push plate from movement relative to said subframe to cause said turf plug to be ejected as said second raise and lower means raises said cutter means.

13. A machine according to claim 12 wherein:

said subframe includes upper and lower portions (126, 127);

said thrust member (212) is mounted on said lower portion (127) of said subframe for free sliding movement between an upper and a lower position;

said actuating means (222) includes a selectively operable fourth locking means (224) for fixedly securing said thrust member (212) in a fixed position relative to said subframe when said cutter is in said lowered position and said plug push plate is adjacent said cutter drive end with said turf plug inside of said cutter to cause said thrust member push plate and turf plug to remain stationary as said second raise-lower means is activated to move said cutter to said raised position.

14. A machine according to claim 13 wherein a third locking means (142) is provided for securing said lower pivot element of said subframe in any desired fore and aft position of adjustment.

15. A machine for cutting and removing a plug of turf from a golf putting green to make a new putting cup hole and, if desired, for inserting said turf plug into an existing cup hole to fill it comprising:

a main frame (20) including an inverted U-shape member having spaced apart front and rear legs (22, 23), each of which has an upper and a lower end (24, 25, 27, 28) and a bight portion (29) connecting said upper ends of said legs, a lower side member (37) mounted between said lower ends of said legs, and a first mounting means (50) for securing said main frame on a vehicle including a main bracket (51) mountable on said vehicle and having a first hinge knuckle means (57, 57'), and a second hinge knuckle means (58, 58') mounted on said main frame front leg (22);

a first raise-lower means (100) including a cylinder (97) having a piston reciprocally mounted therein, said cylinder mounted in said first and second pivot knuckle means to constitute a first generally vertical pivot axis (AX1) about which said main frame can pivot and slide vertically up and down;

a connecting means (102, 104) connected between said piston and said main frame to move said main frame vertically relative to said vehicle upon actuation of said piston, a subframe (120) including a vertically elongated housing (121) having upper, intermediate and lower portions (126, 127, 129), a second mounting means (130) for securing said subframe (120) on said main frame between said front and rear legs including, a lower pivot element (131, 132) defining a second generally horizontal pivot axis slidably mounted on said main frame lower slide member (37) and connected to said intermediate portion of said subframe to permit said subframe to be moved to any desired fore to aft position between said main frame front and rear legs and pivoted relative thereto about said second axis, a cutter means (155) for cutting said turf plug;

a third mounting means (160) for mounting said cutter means to depend from said lower portion of said subframe for rotational and reciprocal movement relative thereto between raised and lowered positions;

a second raise-lower means (200) mounted on said subframe and connected to said cutter means to move said cutter means between said raised and lowered positions;

a drive means (180) operatively connected to said cutter for rotating said cutter means; and a plug ejection means (120) mounted on said subframe and selectively operable to eject said turf plug.

16. A machine according to claim 15 wherein an upper slide member (33) is connected between said legs adjacent said upper ends thereof, an upper pivot element (138) slidably and pivotably connects said top portion of said subframe to said upper slide member, and a fifth locking means (139) is provided to secure said top portion of said subframe in any desired angular position of adjustment relative to said second axis.

17. A machine according to claim 15 wherein said second raise-lower means includes a second hydraulic cylinder member (201) having a piston (202) and piston rod assembly (203) reciprocally mounted therein, said second cylinder mounted on said top portion (126) of said subframe with said piston rod projecting downward toward said cutter means, a drive means housing (182) reciprocally mounted on said subframe and secured to said piston rod, said drive means (180) is mounted in said drive means housing, and said third mounting means for mounting said cutter includes a drive shaft (189) mounted for reciprocating and rotary movement relative to said subframe and has a power input end (191) connected to said drive means and a power output end (192) connected to said cutter whereby reciprocal movement of said piston rod will be transmitted through said drive means housing, drive means, and drive shaft to said cutter.

18. A machine according to claim 17 wherein said subframe includes a bottom wall (127);

said drive shaft (189) is slidably journaled in said bottom wall for rotation about a third axis (AX3), and has an output end (192) extending below said bottom wall;

said cutter means includes a hollow cylindrical cutter member (155) having a drive end (152) connected to said drive shaft output end and a cutting end, and said plug ejection means includes a plug push plate (211) mounted inside of said cutter member for reciprocal movement between said drive and cutting ends, a thrust member (212) reciprocally mounted on said subframe above said bottom wall, a thrust transfer means (213) slidably mounted in said bottom wall and having top and bottom portions connected to said thrust member and push plate, respectively, a fourth lock means (224) for locking said thrust member in a fixed position relative to said subframe when said cutter is in said lowered position and said plug push plate is adjacent said cutter drive end with said turf plug contained in said cutter to cause said thrust member, push plate and turf plug to remain stationary as said second raise-lower means is actuated to move said cutter to said raised position.

19. A machine according to claim 17 wherein said main frame bight portion (29) has a slot (31) therethrough extending between said front and rear legs; and said second hydraulic cylinder (201) extends upward from said subframe and through said slot.

* * * * *